United States Patent [19]

Dietsche

[11] 4,130,376

[45] Dec. 19, 1978

[54] FAN MOUNTING ARRANGEMENT

[75] Inventor: Robert J. Dietsche, Elyria, Ohio

[73] Assignee: Westinghouse Electric Corp., Pittsburgh, Pa.

[21] Appl. No.: 809,351

[22] Filed: Jun. 23, 1977

[51] Int. Cl.[2] ..... F01D 25/24

[52] U.S. Cl. ..... 415/219 C; 417/360; 126/110 R; 312/348

[58] Field of Search ..... 415/219 C, 219 R, 201; 417/360; 126/110 R, 299 R, 299 D; 62/302; 312/348; 55/294

[56] References Cited

U.S. PATENT DOCUMENTS

| | | | |
|---|---|---|---|
| 2,464,473 | 3/1949 | Wessel | 126/110 R X |
| 2,798,660 | 7/1957 | Flynn | 417/360 |
| 2,828,683 | 4/1958 | Joseph et al. | 126/299 D |

*Primary Examiner*—Carlton R. Croyle
*Assistant Examiner*—Donald S. Holland
*Attorney, Agent, or Firm*—E. C. Arenz

[57] ABSTRACT

In a fan mounting arrangement in which a centrifugal fan housing has slide rails which are received in tracks of the fan base plate, the housing has an inclined flange along the edge of the fan discharge opening which leads as the housing is being installed, this flange being elevated by ramp means on the track as the housing approaches its final position so that the flange clears the edge of the opening in the fan base plate and pulls up the leading end of the fan housing for reducing air leakage between the fan housing discharge opening and the fan base plate. Additionally, the slide rails are provided with ramping means adjacent the trailing edge to elevate the trailing edge of the fan housing as it approaches its final position. The slide rails are fastened to the base plate after the fan housing is in its fully slid-in position, to prevent sliding of the housing relative to the base plate and also to insure the fan housing is pulled up tightly to the base plate.

5 Claims, 6 Drawing Figures

FAN MOUNTING ARRANGEMENT

BACKGROUND OF THE INVENTION

1. Field of the Invention

The invention pertains to the art of centrifugal fan mounting arrangements and particularly to those employed in units such as furnaces and air handlers of the type typically used in residences.

2. Description of the Prior Art

Of the prior art of which applicant is aware, the closest which is disclosed in a patent is found in U.S. Pat. No. 2,464,473. The disclosure there which is material to this patent application is of a blower assembly which includes slide rails which are slidably received by horizontal track means which are connected to the horizontal partition or supporting wall. The tracks have cushioning strips secured to the surfaces which support the rails carried by the blower housing. These serve both for shock absorbing purposes as well as promoting a seal between the horizontal supporting wall and the blower housing. Additionally, both front and rear sealing strips are provided to complete the seal between the outlet of the blower housing and the horizontal supporting wall.

In addition to the noted patent, the prior art includes commercial devices in which a centrifugal fan housing is rigidly connected to a horizontal supporting plate, with the plate being slidably received into the cabinet of the furnace by tracks supported on the sides of the furnace.

In another commercial prior art arrangement the fan is provided with slide rails, the horizontal partition has tracks to receive the slide rails, and the manner of effecting an adequate air seal between the fan housing and the horizontal plate is accomplished by using several sheet metal screws which extend through the plate and into the slide rails near both the front and the rear of the furnace. By tightening the sheet metal screws the slide rails and the husing are pulled up tight enough against the plate to provide sufficiently close connection that the amount of air leakage is not undue. One disadvantage of this arrangement is that if the fan housing is to be removed for service or any other reason, there may be difficulty in getting access to the screws at the rear of the furnace because of a vertical interior wall blocking access from the front, and the possibility the furnace may be installed in a closet.

The disadvantage of the prior art arrangement in which the fan housing is more or less permanently secured to the fan plate and the plate itself is arranged to be slid into the furnace is that the assembly as a whole is relatively bulky, heavy and awkard to handle. Also, by virtue of the removability of the sliding plate, the overall rigidity of the furnace is not as great as when the fan plate is permanently fixed.

The aim of the invention is to provide a centrifugal fan mounting arrangement for a furnace or like device which is less bulky, easily removable and serviceable, and which also provides an adequate air seal between the fan housing and the fan base plate.

SUMMARY OF THE INVENTION

In accordance with the invention, the centrifugal fan mounting arrangement is of the type in which slide rails on the fan housing are received in sliding relation by tracks which underlie a base plate provided with an opening to register with the discharge opening of the fan, the fan housing being provided wih flange means at the edge of the discharge opening of the fan housing which leads as the fan housing is slid in a front-to-rear direction along the base plate toward its installed position, the track means being provided with upwardly directed ramp means positioned that the leading edge of the fan housing is lifted before it reaches its final position so that the flange means will clear and overlie the marginal portion of the base plate which bounds the rear edge of the opening in the base plate, and fastener means are provided for fastening the slide rails to the base plate at points on the front side of the discharge opening so that the fan housing as a whole is held up reasonably tightly to the underside of the fan base plate to provide an adequate air seal. In the preferred arrangement, the trailing edge portion of the slide rails are provided with means which engage the forward end of the track means as the fan approaches its final slid position so that the part of the fan housing toward the front of the furnace is also elevated so that the entire fan housing more closely abuts the underside of the base plate.

DRAWING DESCRIPTION

DESCRIPTION OF THE PREFERRED EMBODIMENT

The invention will be described in connection with its application to a forced air furance of the type typically employed in residences, and in particular an oil-fired furnace, although it will be understood that the arrangement according to the invention may well find applicability to other fan mounting arrangments.

Figure 1:
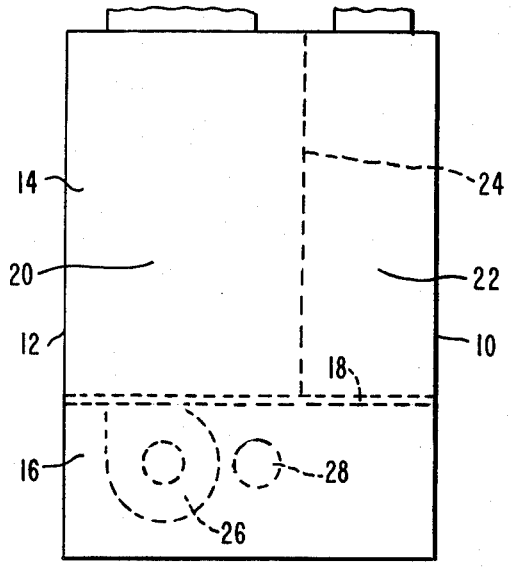
FIG. 1 is a side view of a furnace of the type to which the mounting arrangement of the invention is applicable.

Referring to FIG. 1, the furnace cabinet includes a front wall 10 provided with a removable access panel, rear wall 12, and opposite side walls 14 (only the facing wall 14 being seen in FIG. 1). The interior of the cabinet is divided into three main sections, a lower fan section 16 below the horizontal fan base plate 18 which extends between the opposite sides and the front and rear walls inside the cabinet, an upper rear section 20 containing the heat exchanger and a front upper section 22 separated from section 20 by a vertical partition 24. The vertical partition 24 will typically have the oil burner and controls mounted thereon. Return air to the furnace may be admitted through knockout openings provided in both the bottom wall and the side walls of the blower section. A centrifugal fan 26 is mounted to the fan base plate 18 in the blower section and is driven by an electric motor 28 through a pulley and belt arrangement (not shown).

The description thus far has been of a typical locational arrangement of parts in an oil-fired, forced air furnace.

Figure 2:
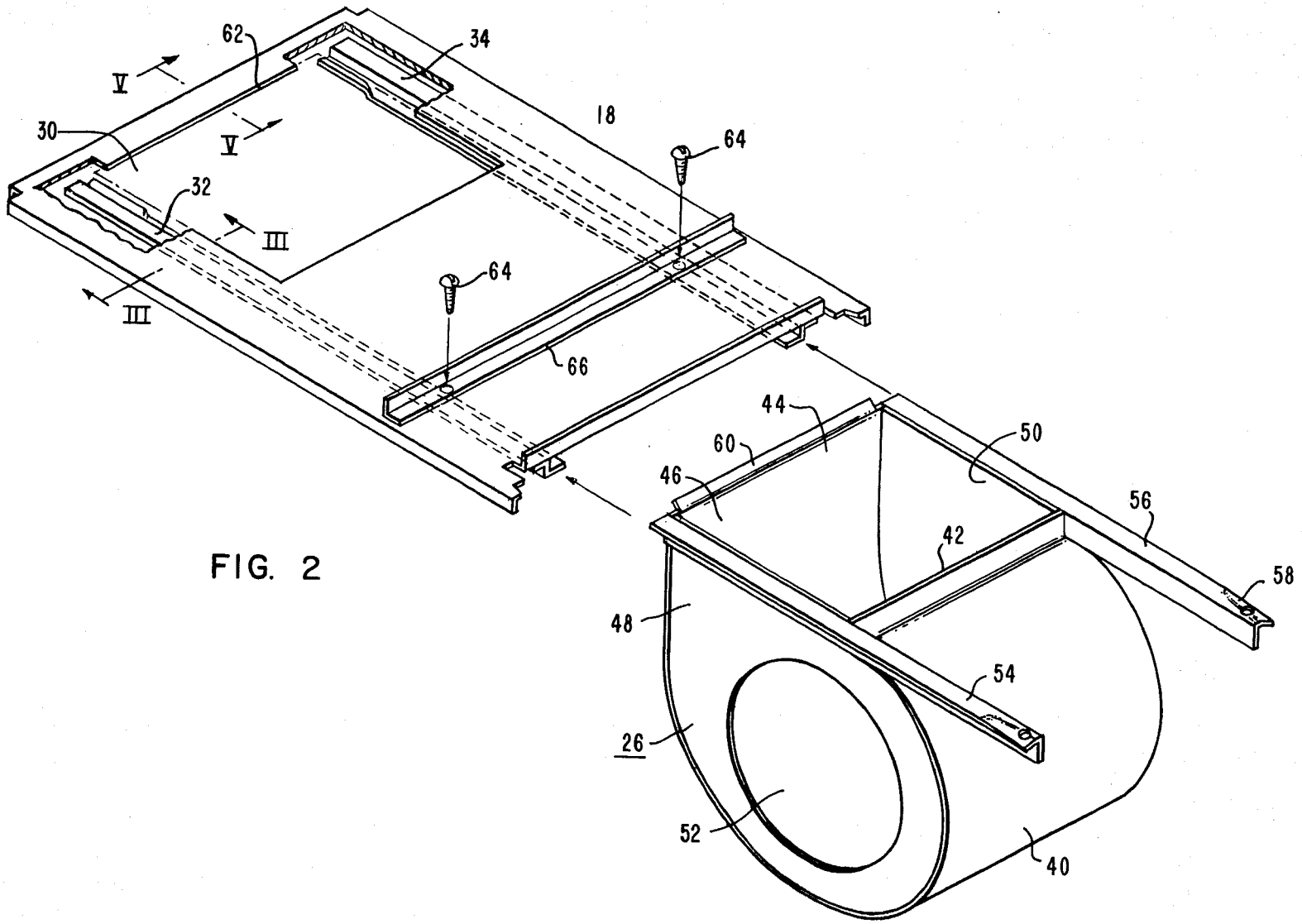
FIG. 2 is an exploded isometric view illustrating the relation of the fan base plate and the fan prior to assembly.

Referring to FIG. 2, the base plate 18 is a generally flat sheet metal member flanged at its sides and front end and is adapted to be permanently fixed in the location as illustrated in FIG. 1. The base plate is provided with an opening 30 adapted to register with the discharge opening of the fan housing 26 when the fan housing is in its finally installed position, the opening 30 being toward the rear of the furnace when the base plate is installed.

Figure 3:
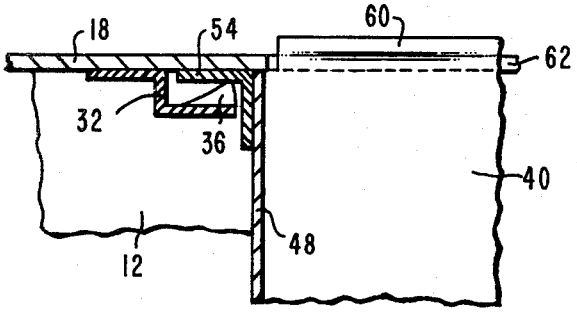
FIG. 3 is a fragmentary detail view in vertical cross section corresponding to one taken along the line III—III of FIG. 2.
Figure 4:
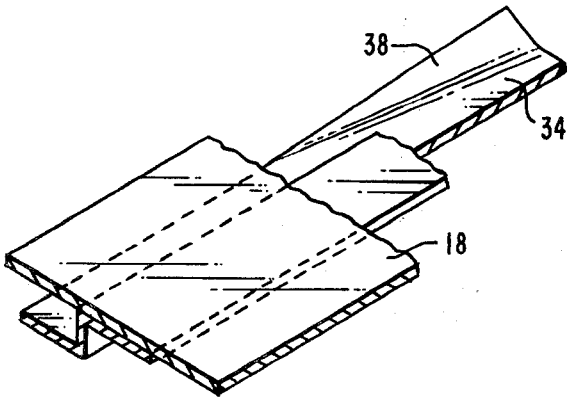
FIG. 4 is a fragmentary detail view showing a portion of the track toward the rear of the furnace.

Left and right tracks 32 and 34 (FIG. 2) extend in parallel relation from front to rear and are secured on the underside of the base plate 18 so that they extend adjacent the opposite side edges of the base plate opening 30. These tracks are generally Z-shaped in vertical cross section, as shown in FIGS. 3 and 4, for all of their length except the portion near the rear wall of the furnace. At their rear ends, the lower legs of the tracks are bent up along several inches of their length as at 36 and 38 (FIGS. 3 and 4) to form the gradually sloping ramps 36 and 38.

The fan housing 26 (FIG. 2) basically includes a wrapper sheet 40 which is formed into a generally scrollshape for its length which generally extends from a point near the fan cutoff 42 to the end location 44 at the side of the discharge opening 46 opposite the cutoff 42, and the opposite sides 48 and 50 of the fan housing which are conventional and include the circular inlets 52 as illustrated.

Figure 6:
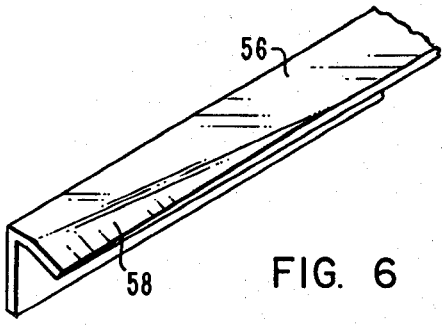
FIG. 6 is a fragmentary isometric view of a portion of the trailing end of the slide rail.

Slide rails 54 and 56, which are angle-shaped in cross section, are secured to the opposite sides 48 and 50 of the fan housing, with the fan housing being of a width so that the slide rails are spaced apart to be received and supported by the tracks 32 and 34 as best seen in FIGS. 2 and 3. The ends of the slide rails which are remote from the housing, that is the trailing ends of the slide rails, are each provided with a downwardly bent end portion 58 in the horizontal leg of the rail, this construction being best seen in connection with rail 56 in FIG. 6.

Figure 5:
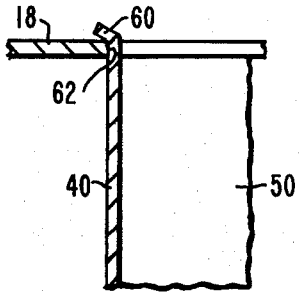
FIG. 5 is a vertical sectional view corresponding to one taken along the line V—V of FIG. 2.

At the rear side of the fan housing, that is the side opposite the cutoff 42, the wrapper sheet is provided with a flanged projection 60 which is preferably upwardly and outwardly inclined as illustrated in FIGS. 2, 3 and 5.

With the arrangement as described, when the fan housing is to be installed by sliding it in a front-to-rear direction into the furnace and underlying the fan base plate 18, the slide rails 54 and 56 are received in the tracks 32 and 34. As the housing approaches its final position in which the housing underlies the rearmost portion of the base plate with the fan discharge opening 46 coming into registry with the opening 30 in the base plate, the ramp means 36 and 38 on the tracks gradually lift the side rails 54 and 56 at their leading ends so the fan housing 26 is also elevated. The ramps have sufficient height that the inclined flange 60 will clear the rear edge 62 of the opening 30 and as the fan housing is pushed further to the rear to its final rearmost position the flange 60 overlies and hooks over the marginal edge portion defining the rear edge 62 of the opening 30. As a result, the leading end of the fan housing has been elevated, and the hooking of the flange over the base plate at the rear edge provides an adequate air seal along that side of the discharge opening.

For elevating that part of the fan housing closer to the front of the furnace, the ramps 58 (FIG. 6) of the slide rails have been effective to also elevate those parts of the fan housing closer to the front so that the top edges of the fan housing defining the discharge opening are brought reasonably closely to the underside of the base plate portions defining the opening 30. The fan housing assembly and slide rails are then secured against forward and rearward movement by turning two fasteners 64, such as sheet metal screws, through bracing angle 66 and down into holes in the slide rails 54 and 56. It will be appreciated that if desired, the elevating ramps 58 at the forward ends of the slide rails may be omitted and the sheet metal fasteners be used to pull the slide rails up tightly to the underside of the base plate. However, it is considered preferable to include the ramps 58 since this insures that the fan housing is reasonably elevated at both ends irrespective of whether a fastener is omitted or loosened somehow.

When it is desired to remove the fan housing for servicing or any other maintenance procedure, the two fasteners 64, which are located on the front (the usual access) side of the vertical partition 24 (FIG. 1), are removed and the fan housing is simply slid out forwardly. Thus access to the fan housing is available wholly from the front side of the furnace with no problem of loosening fasteners near the rear side of the furnace, which typically would be required to pull the fan housing up reasonably tightly to the base plate. The arrangement also provides an adequate air seal without requiring the use of gasketing material and the like which is subject to being damaged in maintenance servicing.

I claim:

1. In a centrifugal fan mounting arrangement of the type in which slide rails on the fan housing are received in sliding relation by track means underlying a base plate provided with an opening to register with the discharge opening of the fan, the improvement comprising:

flange means at the edge of the discharge opening of the fan housing which leads as the fan housing is slid in a front-to-rear direction along the base plate toward its installed position, said flange means projecting from said housing in said leading direction;

upwardly directed ramp means associated with said track means for lifting the leading edge of said fan before it reaches its final position as it is being slid, so that said flange means will clear and overlie the marginal portion of the base plate bounding the rear edge of the opening in the base plate; and means for fastening said slide rails to said base plate at points on the front side of said discharge opening.

2. In a mounting arrangement according to claim 1 including means associated with the trailing edge portion of said slide rails for lifting the trailing edge of the fan before it reaches its final position as it is being slid so that the portions of the fan housing defining the front and side edges of the discharge opening of the fan housing are moved toward a closer abutting relation with the facing parts of the base plate defining the base plate opening.

3. In a mounting arrangement according to claim 1 wherein said flange means is inclined upwardly.

4. An arrangement for mounting a centrifugal fan in a cabinet having a front, rear and opposite sides and with the front being adapted to provide access to the interior of the cabinet, the arrangement comprising:

a fan base plate fixed in said cabinet to extend transversely across the interior thereof, said plate including a rectangular opening therein;

a centrifugal fan housing including a wrapper sheet and sides and having a discharge opening of a size and shape generally corresponding to the opening in the base plate, said fan discharge opening having opposite end boundaries generally defined between the fan cutoff and the end of the wrapper sheet;

track means extending in a front-to-rear direction fixed to the underside of said base plate adjacent the opposite side edges of said base plate opening;

slide rail means fixed along the opposite sides of said blower housing and spaced to be received and supported by said track means as said fan housing is being slid in a front-to-rear direction into said cabinet;

flange means located at the edge of said fan discharge opening corresponding to the end of the wrapper sheet and inclined in an upwardly and rearwardly direction;

ramp means for said track means for lifting the leading end of said fan housing before it reaches its final installed position so that said inclined flange means will clear and overlie the marginal portion of the base plate bounding the rear edge of the opening in the base plate; and means for fastening the forward end portions of said slide rails to said base plate when said fan housing is in its final installed position so that said fan housing is retained against sliding relative to said base plate and said fan housing is pulled up toward said base plate along its front portion.

5. An arrangement according to claim 4 including:

ramp means adjacent the forward end portion of said slide rails for elevating the forward portion of said slide rails toward the base plate as said fan housing approaches its fully slid-in position.

* * * * *